US010655807B2

(12) United States Patent
Hemon et al.

(10) Patent No.: US 10,655,807 B2
(45) Date of Patent: May 19, 2020

(54) METHOD AND APPARATUS FOR VEHICLE LIGHTING

(71) Applicant: Valeo North America, Inc., Troy, MI (US)

(72) Inventors: Julien Hemon, Queretaro (MX); Enrique Granell, Queretaro (MX); David Solis, Queretaro (MX)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 16/116,532

(22) Filed: Aug. 29, 2018

(65) Prior Publication Data

US 2020/0072427 A1 Mar. 5, 2020

(51) Int. Cl.

| | |
|---|---|
| ***F21S 41/147*** | (2018.01) |
| ***F21S 41/151*** | (2018.01) |
| ***F21S 41/33*** | (2018.01) |
| ***F21S 41/40*** | (2018.01) |
| *F21Y 115/10* | (2016.01) |

(52) U.S. Cl.

CPC ..... *F21S 41/147* (2018.01); *F21S 41/33* (2018.01); *F21S 41/40* (2018.01); *F21Y 2115/10* (2016.08)

(58) Field of Classification Search

CPC ..... F21S 41/33; F21S 41/331; F21S 41/332; F21S 41/333; F21S 41/334; F21S 41/335; F21S 41/336; F21S 41/337; F21S 41/338; F21S 41/36; F21S 41/40; F21S 41/43; F21S 41/435; F21S 41/47

USPC ..... 362/508

See application file for complete search history.

(56) References Cited

U.S. PATENT DOCUMENTS

| | | | | |
|---|---|---|---|---|
| 5,954,428 | A | 9/1999 | Eichhorn et al. | |
| 6,325,528 | B1 | 12/2001 | Wittmeier et al. | |
| 2007/0257272 | A1* | 11/2007 | Hutchins | H01L 25/0753 257/98 |
| 2008/0112180 | A1* | 5/2008 | Okada | F21S 41/155 362/518 |
| 2012/0039083 | A1* | 2/2012 | Meyrenaud | F21S 41/36 362/516 |
| 2012/0120652 | A1* | 5/2012 | Bolander, Jr. | F21V 7/0008 362/235 |
| 2013/0027958 | A1 | 1/2013 | Okubo | |
| 2015/0219301 | A1* | 8/2015 | Honda | F21S 41/336 362/517 |
| 2015/0300588 | A1* | 10/2015 | Wang | F21S 41/143 362/516 |
| 2019/0001864 | A1* | 1/2019 | Makino | B60Q 1/0088 |
| 2019/0145595 | A1* | 5/2019 | Takada | F21S 41/147 |
| 2019/0226658 | A1* | 7/2019 | Kawai | F21S 41/143 |

FOREIGN PATENT DOCUMENTS

| | | |
|---|---|---|
| EP | 0926431 | 6/1999 |
| EP | 2363320 | 9/2011 |

* cited by examiner

*Primary Examiner* — Christopher M Raabe

(74) *Attorney, Agent, or Firm* — Valeo North America, Inc.

(57) ABSTRACT

Aspects of the disclosure provide a lighting apparatus. The lighting apparatus includes a first light source, a second light source and a reflector. The first light source is configured to emit first light in a first direction. The second light source is configured to emit second light in a second direction with a tilt angle to the first direction. The reflector is configured to have a reflection surface. The reflection surface has a first portion that reflects the first light and a second portion that reflects the second light.

14 Claims, 6 Drawing Sheets

METHOD AND APPARATUS FOR VEHICLE LIGHTING

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Generally, a vehicle includes various lighting devices for illumination and signaling. The lighting devices are mounted or integrated at various positions, such as front, rear, sides, top, bottom and the like of the vehicle. The lighting devices can light the roadway for the driver, increase the visibility of the vehicle, and can be used to signal driver's intention to other drivers and pedestrians.

SUMMARY

Aspects of the disclosure provide a lighting apparatus. The lighting apparatus includes a first light source, a second light source and a reflector. The first light source is configured to emit first light in a first direction. The second light source is configured to emit second light in a second direction with a tilt angle to the first direction. The reflector is configured to have a reflection surface. The reflection surface has a first portion that reflects the first light and a second portion that reflects the second light.

In some embodiments, the first light source includes a first plurality of light emitting diodes (LEDs) and the second light source includes a second plurality of LEDs. In an example, the first plurality of LEDs is bonded on a first printed circuit board (PCB), and the second plurality of LEDs is bonded on a second PCB. The first PCB and the second PCB are positioned to have the tilt angle between the first PCB and the second PCB. In an example, the tilt angle is in a range of [15°, 75°].

In some embodiments, the reflector is configured that the first portion has a first focus point, and the second portion has a second focus point. The first light source is positioned at the first focus point and the second light source is positioned at the second focus point.

Further, in an example, the lighting apparatus includes a light shield configured to block the first light to project to the second portion of the reflection surface and block the second light to project to the first portion of the reflection surface.

Aspects of the disclosure provide a method for assembling a lighting apparatus. The method includes disposing a first light source that emits first light in a first direction, disposing a second light source that emits second light in a second direction with a tilt angle to the first direction, and disposing a reflector having a reflection surface. The reflection surface has a first portion that reflects the first light and a second portion that reflects the second light.

Aspects of the disclosure also provide a vehicle, and the lighting apparatus is installed on the vehicle.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

According to aspects of the disclosure, a lighting system can include multiple light sources, such as a first light source and a second light source, with tilt angles between the multiple light sources. Thus, the multiple light sources can provide separate light cones in different directions. Further, the lighting system includes components that are shared by the multiple light sources, such as a reflector, a heat sink, electrical control board and the like. In some embodiments, the reflector is implemented to have a first portion and a second portion. The first light source is positioned at the focus of the first portion and the second light source is positioned at the focus of the second portion. Thus, multiple functions can be implemented in the light system without a significantly size increase of the light system and/or a decrease in light efficiency.

Figure 1:
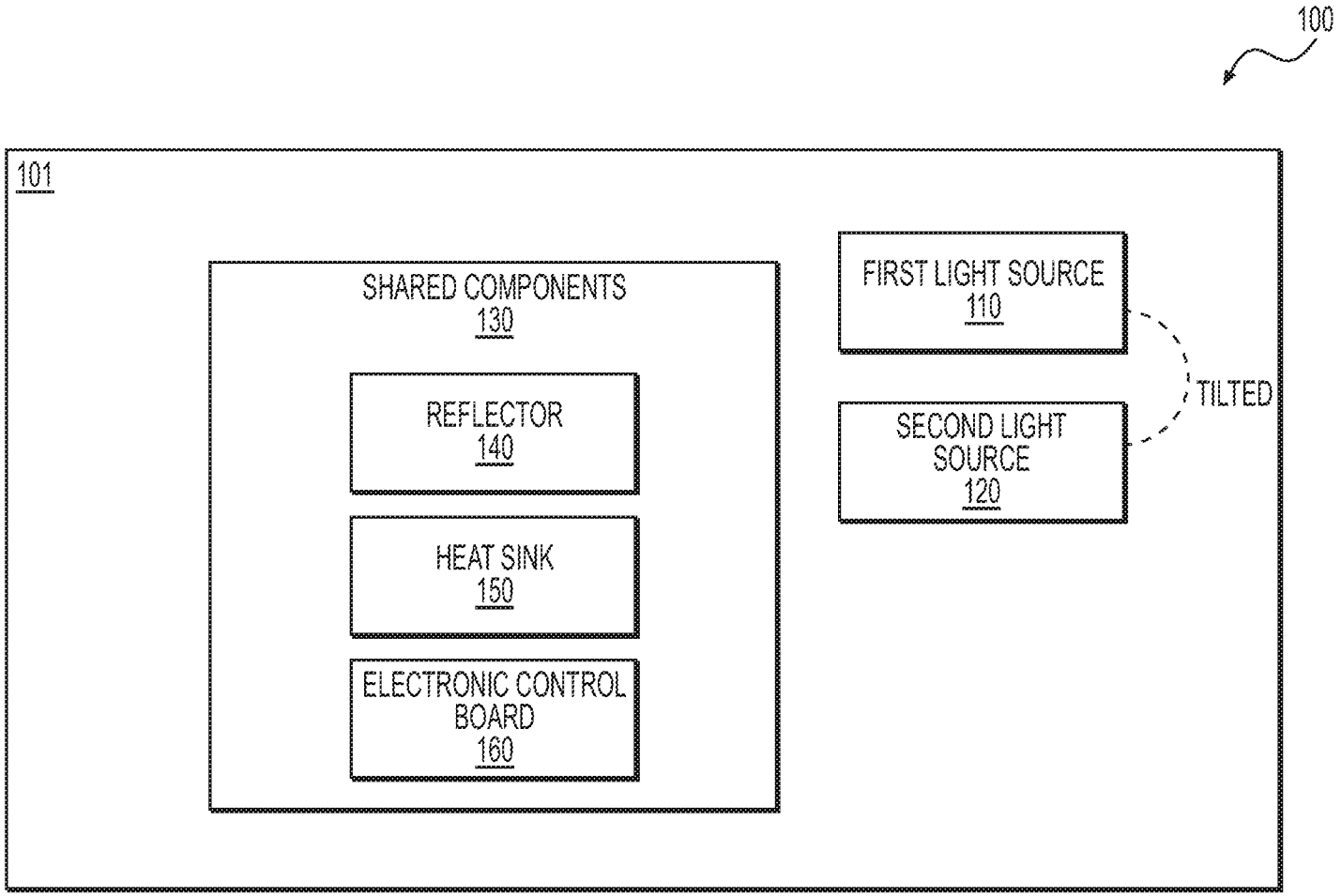
FIG. 1 shows a block diagram of a lighting apparatus 101 according to an embodiment of the disclosure.

FIG. 1 shows a block diagram of a lighting apparatus 101 according to an embodiment of the disclosure. The lighting apparatus 101 includes multiple light sources, such as a first light source 110, a second light source 120, and the like. The multiple light sources are arranged with tilt angles in between. For example, the first light source 110 and the second light source 120 are arranged to have a tilt angle between the first light source 110 and the second light source 120. Further, the lighting apparatus 101 includes components 130 that are shared by the multiple light sources. In the FIG. 1 example, the shared components 130 include a reflector 140, a heat sink 150, and an electronic control board 160.

The lighting apparatus 101 can include other components (not shown) that are shared by the first light source 110 and the second light source 120, such as a housing for the lighting apparatus 101, a connector for power wire connection between a power source and the first and second light sources 110 and 120, and the like.

The lighting apparatus 101 can be any suitable lighting apparatus, such as a lighting apparatus in a vehicle, a lighting apparatus for residential usage, and the like. In the FIG. 1 example, the lighting apparatus 101 is used in a vehicle 100. In an example, the lighting apparatus 101 is mounted at a front position of the vehicle 100 for front lighting. The lighting apparatus 101 receives external control signals, such as vehicle control signals from a vehicle center controller (not shown) of the vehicle 100, and operates in response to the external control signals.

In an example, the lighting apparatus 101 is configured to provide high beam with different features, such as different shapes, different intensities, and the like. When the vehicle center controller provides the external control signals for a high beam of a specific feature, the lighting apparatus 101 emits high beam light of the specific feature and the high beam light meets suitable vehicle lighting regulations, such as the world forum for harmonization of vehicle regulations, and the like accordingly. For example, the first light source 110 is turned on to provide a regular high beam. When additional light intensity is needed in an example, the second light source 120 can be turned on.

In another example, the lighting apparatus 101 is configured to provide low beam with different features, such as different shapes, different intensities, and the like. When the vehicle center controller provides the external control signals for a low beam of a specific feature, the lighting apparatus 101 emits low beam light of the specific feature, and the low bean light meets the suitable vehicle lighting regulations accordingly. For example, the first light source 110 is turned on to provide a regular low beam. When additional light intensity is needed in an example, the second light source 120 can be turned on.

In another example, the lighting apparatus 101 is configured to provide both low beam and high beam. In an example, the first light source 110 is configured to provide low beam and the second light source 120 is configured to provide high beam. When the vehicle center controller provides the external control signals to turn on the first light source 110 and keep the second light source 120 to be turned off, the lighting apparatus 101 emits low beam; and when the vehicle center controller provides the external control signals to turn on the second light source 120 and keep the first light source 110 to be turned off, the lighting apparatus 101 emits high beam accordingly.

The multiple light sources can be the same light sources or can be different light sources. In an embodiment, the first light source 110 and the second light source 120 are light emitting diode (LED) type light sources. In an example, the first light source 110 includes a first plurality of light emitting diodes that is bonded on a first substrate, and the second light source 120 includes a second plurality of light emitting diodes that is bonded on a second substrate. The first light source 110 and the second light source 120 are arranged to have a tilt angle. In an example, the first substrate and the second substrate are arranged with a tilt angle, such as an angle in the range of [15°, 75°], and the like. Thus, the first substrate and the second substrate are not in the same plane. In some embodiments, the light emitted by the first light source 110 forms a first light cone, and the light emitted by the second light source 120 forms a second light cone. Then, the angle between the center lines of the first light cone and the second light cone is equivalent to the tilt angle.

It is noted that the first light source 110 and the second light source 120 respectively can be other suitable light sources, such as a laser lighting device, and the like.

The reflector 140 is configured to reflect the emitted light by the first light source 110 and/or the second light source 120 to form certain light shape. In some embodiments, the reflector 140 is made of a light non-transmissible member, such as a resin member. In some example, the reflector 140 includes a plurality of reflection strips that are suitably shaped. According to an aspect of the disclosure, due to the tilt angle between the first light source 110 and the second light source 120, the first light cone is projected to a first portion of the reflector 140 and is reflected by the first portion of the reflector 140. Similarly, the second light cone is projected to a second portion of the reflector 140 and is reflected by the second portion of the reflector 140.

According to an aspect of the disclosure, the reflector 140 is suitably configured to reduce dispersion of the reflected light of the multiple light sources, and thus increase efficiency of the reflected light. In an example, the first portion of the reflector 140 is suitably shaped, such that the first light source 110 is the focus of the first portion of the reflector 140. When the emitted light from the first light source 110 is reflected by the first portion of the reflector 140, the reflected light is collimated light. Similarly, the second portion of the reflector 140 is suitably shaped, such that the second light source 120 is the focus of the second portion of the reflector 140. When the emitted from the second light source 120 is reflected by the second portion of the reflector 140, the reflected light is collimated light.

According to the embodiment of FIG. 1, the heat sink 150 is configured to suitably dissipate heat generated by the first light source 110 and the second light source 120. In some examples, the first light source 110 and the second light source 120 are LED lighting devices. An LED is formed of a p-n junction on a semiconductor substrate. The operation of the LED is affected by a junction temperature. For example, high junction temperature can decrease brightness, reduce efficiency, and affect the lifetime of the LED.

During operation, in some examples, when current is driven to the LEDs in the first light source 110 (and/or the second light source 120), the LEDs generate heat due to inefficiency. The heat sink 150 can dissipate the heat generated by the first light source 110 (and/or the second light source 120), and thus maintain the junction temperature to be relatively low. The relatively low junction temperature can maintain a relatively high brightness of the light emitted by the LEDs, maintain a relatively high efficiency, and prolong the lifetime of the LEDs.

In some embodiments, the electronic control board 160 includes protection circuitry, power regulation circuitry and control circuitry for both the first light source 110 and the second light source 120. In some examples, the protection circuitry is configured to provide protection, such as to electrostatic discharge (ESD), and the like for incoming signals, power lines, and the like respectively for the first light source 110 and the second light source 120. The power regulation circuitry is configured to provide suitable driving current respectively to the first light source 110 and the second light source 120. The control circuitry is configured to provide suitable pulse width modulation (PWM) signals to control the power regulation circuitry to generate the suitable driving current respectively for the first light source 110 and the second light source 120.

In an example, the size of the lighting apparatus 101 is about the same size as a related example that includes one light source. For example, the size of a lighting apparatus is dominated by the sizes of the reflector, the heat sink and the electronic control board in the lighting apparatus. Thus, when the reflector 140, the heat sink 150 and the electronic control board 160 are shared by the first light source 110 and the second light source 120 and are about the same as in the related example, the size of the lighting device 101 is about the same size as the related example that includes one light source.

Figure 2:
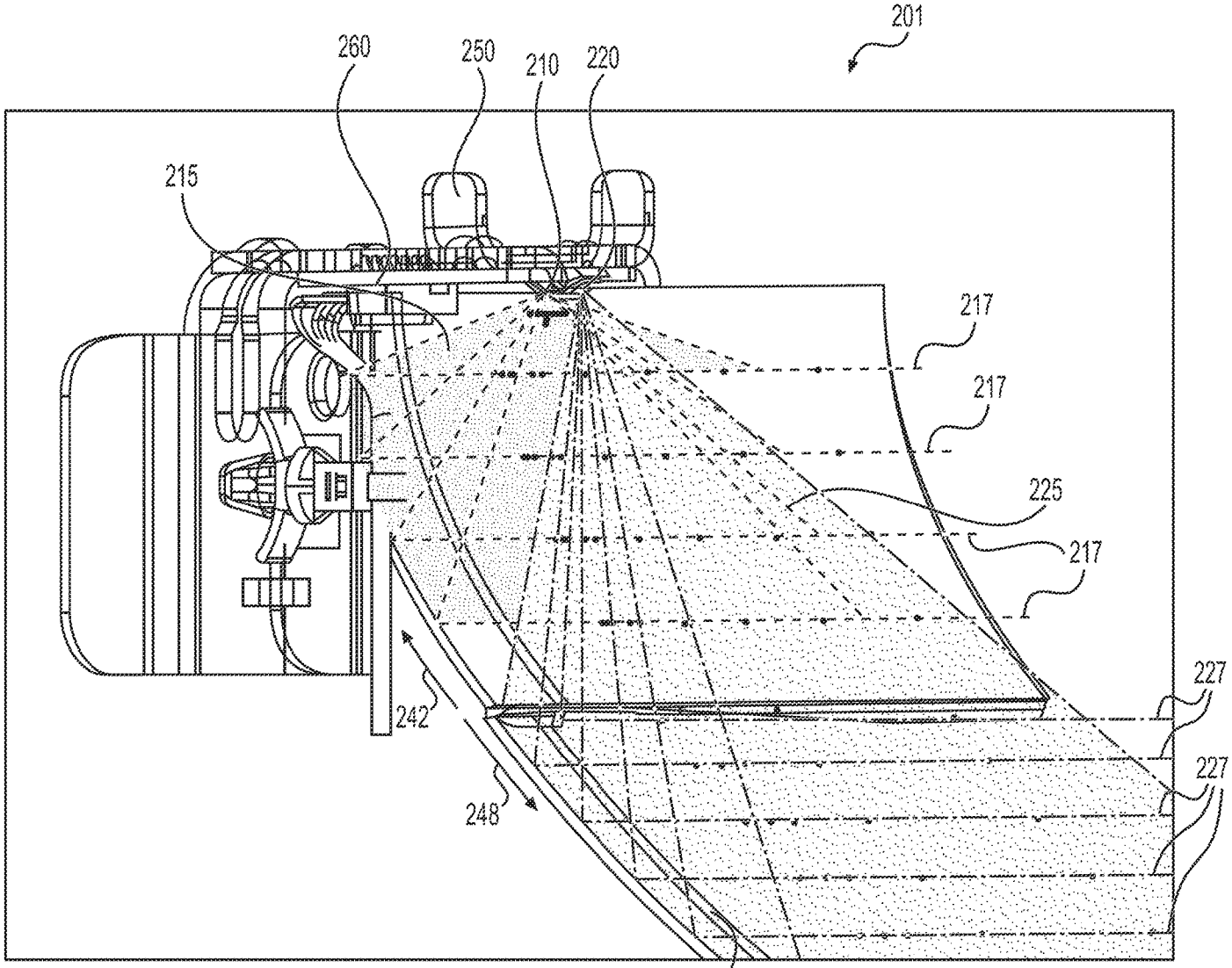
FIG. 2 shows a cross-section view of a lighting apparatus 201 according to an embodiment of the disclosure.

FIG. 2 shows a cross-section view of a lighting apparatus 201 according to an embodiment of the disclosure. The lighting apparatus 201 is an implementation of the lighting apparatus 101 in an example. The lighting apparatus 201 includes a first light source 210 and a second light source 220, and the like. Further, the lighting apparatus 201 includes a reflector 240, a heat sink 250, and an electronic control board 260.

In an embodiment, the first light source 210 and the second light source 220 are LED light sources. In an example, the first light source 210 includes a first plurality of LEDs that is bonded on a first substrate, and the second light source 220 includes a second plurality of LEDs that is bonded on a second substrate. The first substrate and the second substrate are arranged with a tilt angle. The light emitted by the first light source 210 forms a first light cone 215, and the light emitted by the second light source 220 forms a second light cone 225. Then, the angle between the center lines of the first light cone 215 and the second light cone 225 is equivalent to the tilt angle.

The reflector 240 is configured to reflect the emitted light by the first light source 210 and/or the second light source 220 to form certain light shape. According to an aspect of the disclosure, the reflector 240 is configured to have a first portion 242 and a second portion 248. The first portion 242 is suitably configured, such that the first light source 210 is positioned at the focus of the first portion 242. The first portion 242 reflects the first light cone 215 to generate collimated light 217. The second portion 248 is suitably configured, such that the second light source 220 is positioned at the focus of the second portion 248. The second portion 248 reflects the second light cone 225 to generate collimated light 227.

According to the example shown in FIG. 2, the heat sink 250 is configured to suitably dissipate heat generated by the first light source 210 and the second light source 220. The electronic control board 260 includes protection circuitry, power regulation circuitry and control circuitry for both the first light source 210 and the second light source 220 in an example.

In an example, the size of the lighting apparatus 201 is about the same size as the related example that includes one light source. For example, the size of the lighting apparatus 201 is dominated by the sizes of the reflector 240, the heat sink 250 and the electronic control board 260. Thus, when the reflector 240, the heat sink 250 and the electronic control board 260 are shared by the first light source 210 and the second light source 220 and are about the same size as in the related example, the size of the lighting device 201 is about the same size as the related example that includes one light source.

Figure 3:
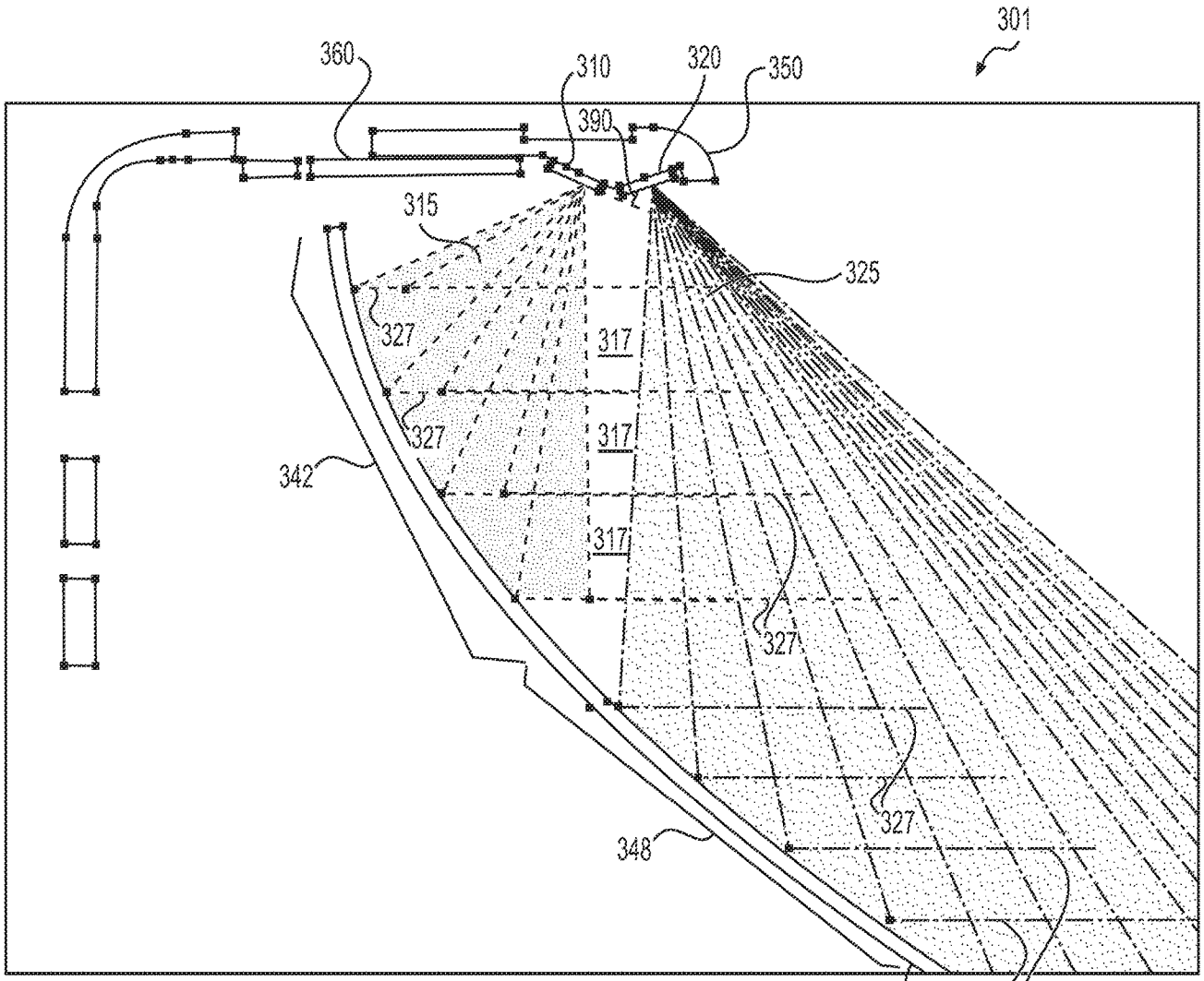
FIG. 3 shows a schematic view of a lighting apparatus 301 according to an embodiment of the disclosure.

FIG. 3 shows a simplified schematic view of a lighting apparatus 301 according to an embodiment of the disclosure. The lighting apparatus 301 is similarly configured as the lighting apparatus 201, and some components of the lighting apparatus 301 are omitted here for clarity purposes. The lighting apparatus 301 includes a first light source 310 and a second light source 320. Further, the lighting apparatus 301 includes a reflector 340, a heat sink 350, and an electronic control board 360.

In an embodiment, the first light source 310 and the second light source 320 are LED light sources. In an example, the first light source 310 includes a first plurality of LEDs that is bonded on a first substrate, and the second light source 320 includes a second plurality of LEDs that is bonded on a second substrate. The first substrate and the second substrate are arranged with a tilt angle 390 as shown. The light emitted by the first light source 310 forms a first light cone 315, and the light emitted by the second light source 320 forms a second light cone 325. Then, the angle between the center lines of the first light cone and the second light cone is equivalent to the tilt angle.

The reflector 340 is configured to reflect the emitted light by the first light source 310 and/or the second light source 320 to form certain light shape. According to an aspect of the disclosure, the reflector 340 is configured to have a first portion 342 and a second portion 348. The first portion 342 is suitably configured, such that the first light source 310 is positioned at the focus of the first portion 342. The first portion 342 reflects the first light cone 315 to generate collimated light 317. The second portion 348 is suitably configured, such that the second light source 320 is positioned at the focus of the second portion 348. The second portion 348 reflects the second light cone 325 to generate collimated light 327.

The heat sink 350 is configured to suitably dissipate heat generated by the first light source 310 and the second light source 320. The electronic control board 360 includes protection circuitry, power regulation circuitry and control circuitry for both the first light source 310 and the second light source 320.

Figure 4:
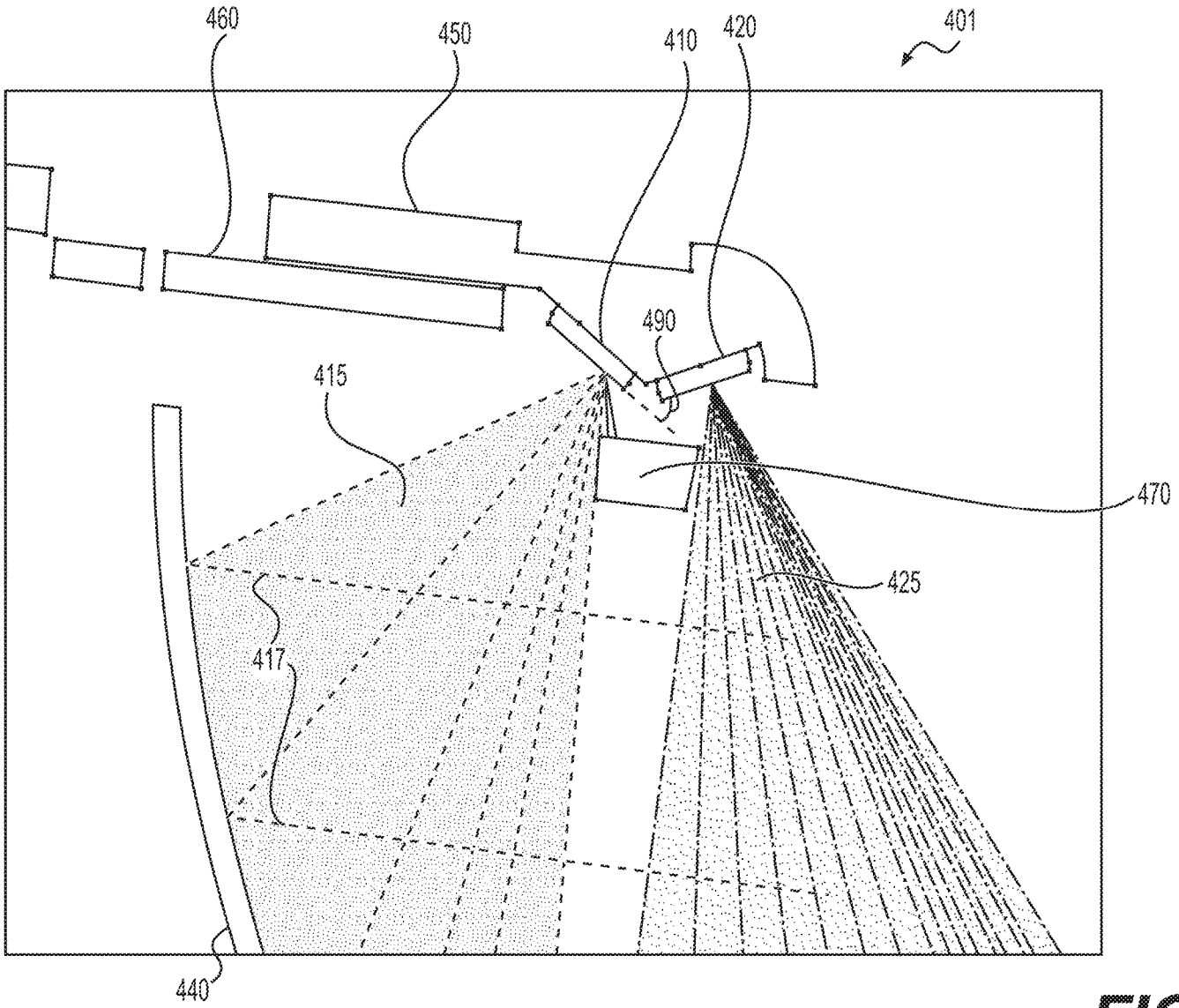
FIG. 4 shows a schematic view of a lighting apparatus 401 according to an embodiment of the disclosure.

FIG. 4 shows a simplified schematic view of a lighting apparatus 401 according to an embodiment of the disclosure. The lighting apparatus 401 also utilizes certain components that are identical or equivalent to those used in the lighting device 301; the description of these components has been provided above and will be omitted here for clarity purposes. However, in this embodiment, the lighting apparatus 401 includes a shield 470 that is arranged between the first light source 410 and the second light source 420. The shield 470 is configured to restrain light cones formed from the first light source 410 and the second light source 420.

Similar to the reflector 340 in FIG. 3, the reflector 440 is configured to have a first portion and a second portion (not shown). The first portion is suitably configured, such that the first light source 410 is positioned at the focus of the first portion. The first portion reflects the first light cone 415 to generate collimated light 417. The second portion is suitably configured, such that the second light source 420 is positioned at the focus of the second portion. The second portion reflects the second light cone 425 to generate collimated light (not shown). The shield 470 is configured to block the light emitted by the first light source 410 from a projection to the second portion of the reflector 440 and block the light emitted by the second light source 420 from a projection to the first portion of the reflector 440.

In an example, the first light source 410 and the second light source 420 are for different functions, the shield 470 is configured to ensure that no light leakage between the first light cone 415 and the second light cone 425 for each function. In an example, the shield 470 is a light non-transmissible member.

It is noted that, in another example, the lighting apparatus 401 can include two shields that respectively restrain the light cones formed from the first light source 410 and the second light source 420.

Figure 5:
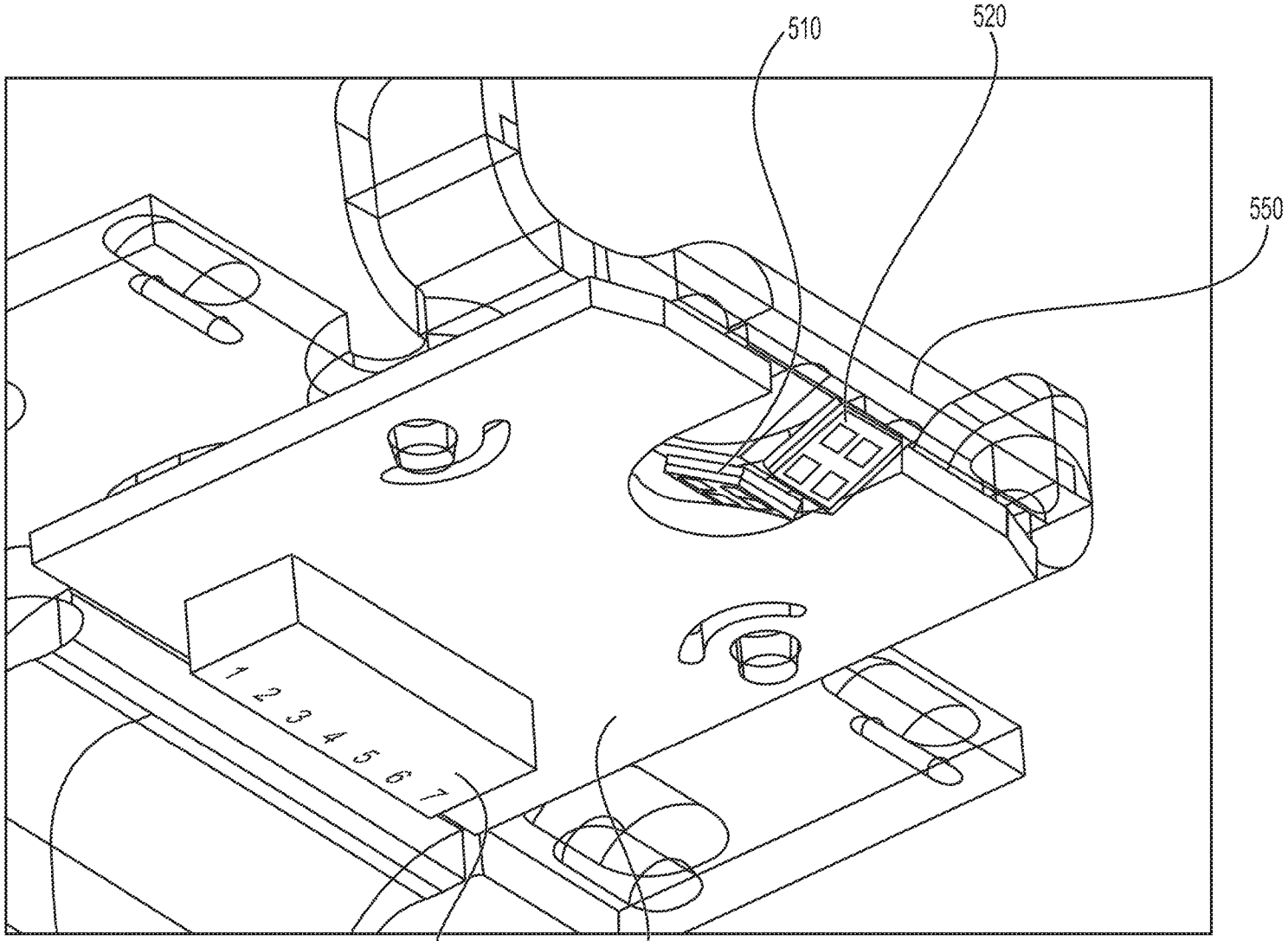
FIG. 5 shows a schematic view of a lighting apparatus 501 according to an embodiment of the disclosure.

FIG. 5 shows a three-dimensional pictorial view of a lighting apparatus 501 according to an embodiment of the disclosure. The lighting apparatus 501 includes a first light source 510 and a second light source 520. In the FIG. 5 example, the first light source 510 includes 4 LED chips that are bonded on a first substrate, and the second light source 520 includes 4 LED chips that are bonded on a second substrate. The first substrate and the second substrate are arranged with a tilt angle, and are not in the same plane. Additional, FIG. 5 shows a heat sink 550, and an electronic control board 560 that are shared by the first light source 510 and the second light source 520. FIG. 5 also shows a connector 580. The connector 580 is configured to receive external control signals, such as vehicle control signals, from for example a vehicle controller. The lighting apparatus 501 includes other components, such as a reflector and the like, that are not shown in FIG. 5.

Figure 6:
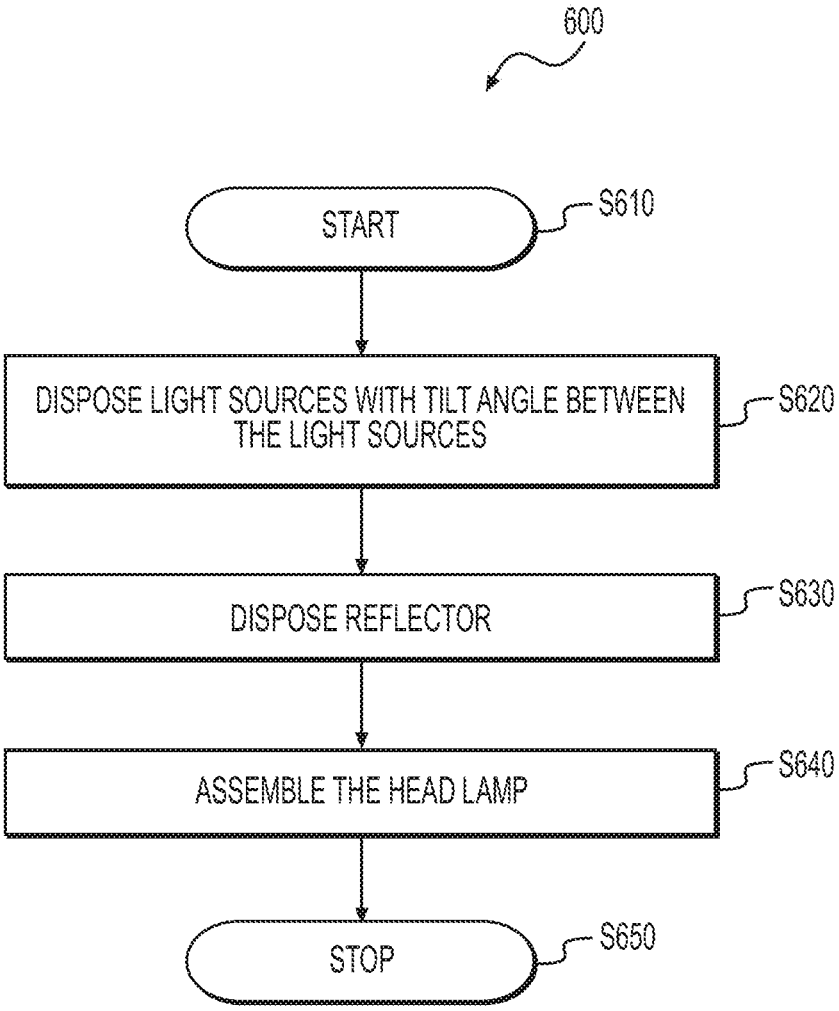
FIG. 6 shows a flow chart outlining a process example 600 according to an embodiment of the disclosure.

FIG. 6 shows a flow chart outlining a process example 600 according to an embodiment of the disclosure. In an example, the process 600 is used to assemble a lighting apparatus, such as the lighting apparatus 201, the lighting apparatus 301, the lighting apparatus 401, the lighting apparatus 501, and the like. The process starts at S610, and proceeds to S620.

At S620, light sources are disposed with tilt angles. In an example, a first light source and a second light source are disposed. The first light source includes multiple LED chips that are bonded on a first substrate, and the second light source includes multiple LED chips that are bonded on a second substrate. The first substrate and the second substrate are arranged with a tilt angle. In an example, the tile angle is a predetermined fixed angle.

At S630, a reflector is disposed with suitable spatial relationship to the light sources. In an example, the first light source is positioned at a focus point of a first portion of the reflector, and the second light source is positioned at a focus point of a second portion of the reflector.

At S640, other components are assembled together to form a head lamp. The head lamp can then be installed in a vehicle. Then, the process proceeds to S650 and terminate.

It is noted that, in some embodiments, the sequence of steps in the process 600 are suitably changed.

When implemented in hardware, the hardware may comprise one or more of discrete components, an integrated circuit, an application-specific integrated circuit (ASIC), etc.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A lighting apparatus of a vehicle, comprising:

a first light source configured to emit first light in a first direction, the first light source including a first plurality of light emitting diodes (LEDs), the first plurality of LEDs being bonded on a first printed circuit board (PCB);

a second light source configured to emit second light in a second direction with a tilt angle to the first direction, the second light source including a second plurality of LEDs, the second plurality of LEDs being bonded on a second PCB, the first PCB and the second PCB being positioned to have the tilt angle between the first PCB and the second PCB; and a reflector configured to be a single piece, the single piece having a reflection surface, the reflection surface having a first portion that reflects the first light and a second portion that reflects the second light.

2. The lighting apparatus of the vehicle according to claim 1, wherein the second light source is configured to emit the second light in the second direction with the tilt angle in a range of [15°, 75° ] to the first direction.

3. The lighting apparatus of the vehicle according to claim 1, wherein the reflector is configured that the first portion has a first focus point, and the second portion has a second focus point.

4. The lighting apparatus of the vehicle according to claim 3, wherein the first light source is positioned at the first focus point and the second light source is positioned at the second focus point.

5. The lighting apparatus of the vehicle according to claim 1, further comprising:

a light shield configured to block the first light to project to the second portion of the reflection surface and block the second light to project to the first portion of the reflection surface.

6. A method of a vehicle lighting device comprising:

disposing a first light source that emits first light in a first direction;

disposing a second light source that emits second light in a second direction with a tilt angle to the first direction;

disposing a reflector that is a single piece, the single piece having a reflection surface, the reflection surface having a first portion that reflects the first light and a second portion that reflects the second light;

disposing the first light source that includes a first plurality of light emitting diodes (LEDs);

disposing the second light source that includes a second plurality of LEDs;

disposing a first printed circuit board (PCB) with the first plurality of LEDs bonded on the PCB; and disposing a second PCB with the second plurality of LEDs bonded on the second PCB, and the first PCB and the second PCB being positioned to have the tilt angle between the first PCB and the second PCB.

7. The method of a vehicle lighting device according to claim 6, further comprising:

disposing the second light source that emits the second light in the second direction with the tilt angle in a range of [15°, 75° ] to the first direction.

8. The method of the vehicle lighting device according to claim 6, further comprising:

disposing the first light source at a first focus point of the first portion of the reflector; and disposing the second light source at a second focus point of the second portion of the reflector.

9. The method of the vehicle lighting device according to claim 6, further comprising:

disposing a light shield that blocks the first light to project to the second portion of the reflection surface and blocks the second light to project to the first portion of the reflection surface.

10. A vehicle having a lighting apparatus, the lighting apparatus comprising:

a first light source configured to emit first light in a first direction, the first light source including a first plurality of light emitting diodes (LEDs), the first plurality of LEDs being bonded on a first printed circuit board (PCB);

a second light source configured to emit second light in a second direction with a tilt angle to the first direction, the second light source including a second plurality of LEDs, the second plurality of LEDs being bonded on a second PCB, the first PCB and the second PCB being positioned to have the tilt angle between the first PCB and the second PCB; and a reflector configured to be a single piece, the single piece having a reflection surface, the reflection surface having a first portion that reflects the first light and a second portion that reflects the second light.

11. The vehicle of claim 10, wherein the second light source is configured to emit the second light in the second direction with the tilt angle in a range of [15°, 75° ] to the first direction.

12. The vehicle of claim 10, wherein the reflector is configured that the first portion has a first focus point, and the second portion has a second focus point.

13. The vehicle of claim 12, wherein the first light source is positioned at the first focus point and the second light source is positioned at the second focus point.

14. The vehicle of claim 10, wherein the lighting apparatus further comprises:

a light shield configured to block the first light to project to the second portion of the reflection surface and block the second light to project to the first portion of the reflection surface.

* * * * *